US011660780B2

(12) United States Patent
McAlinden

(10) Patent No.: US 11,660,780 B2
(45) Date of Patent: May 30, 2023

(54) MIXING APPARATUS AND METHOD FOR PREPARING MORTAR

(71) Applicant: Rigid Mixers Limited, Craigavon (GB)

(72) Inventor: Conor McAlinden, Craigavon (GB)

(73) Assignee: Rigid Mixers Limited, Craigavon (GB)

( * ) Notice: Subject to any disclaimer, the term of this patent is extended or adjusted under 35 U.S.C. 154(b) by 829 days.

(21) Appl. No.: 16/603,903

(22) PCT Filed: Apr. 11, 2018

(86) PCT No.: PCT/EP2018/059313

§ 371 (c)(1),
(2) Date: Oct. 9, 2019

(87) PCT Pub. No.: WO2018/192824

PCT Pub. Date: Oct. 25, 2018

(65) Prior Publication Data

US 2020/0114541 A1 Apr. 16, 2020
US 2020/0114541 A1 Apr. 16, 2020

(30) Foreign Application Priority Data

Apr. 19, 2017 (GB) ..... 1706192

(51) Int. Cl.
*B28C 5/00* (2006.01)
*B28C 5/12* (2006.01)
(Continued)

(52) U.S. Cl.
CPC ..... *B28C 5/1284* (2013.01); *B01F 23/53* (2022.01); *B01F 27/90* (2022.01);
(Continued)

(58) Field of Classification Search
CPC . B28C 5/1284; B28C 5/0818; B01F 2101/28; B01F 23/53; B01F 35/71775
See application file for complete search history.

(56) References Cited

U.S. PATENT DOCUMENTS 2,366,673 A 1/1945 Paley
4,855,960 A 8/1989 Janssen et al.
(Continued)

FOREIGN PATENT DOCUMENTS

CN 204054340 U 12/2014
GB 2098497 A 11/1982
(Continued)

*Primary Examiner* — Anshu Bhatia
(74) *Attorney, Agent, or Firm* — Standley Law Group LLP; Adam J. Smith

(57) ABSTRACT

A mixing apparatus for preparing mortar has a screw conveyor for conveying dry material, such as a mixture of sand and cement, from a storage vessel to a mixing chamber. The mixing chamber has an inlet end, adapted to receive dry material from an outlet end of the screw conveyor, an outlet end for dispensing wet mortar, and a water feed between the inlet and outlet ends for delivering a metered flow or quantity of water into the mixing chamber. A mixing device within the mixing chamber mixes the dry material and water and controls passage of material from the inlet to the outlet end. The outlet end is located above said inlet end so the dry material falls under gravity from the outlet end into the mixing chamber, maintaining separation between the dry material in the screw conveyor and the wet material in the mixing chamber.

28 Claims, 3 Drawing Sheets

(51) Int. Cl.

| | |
|---|---|
| ***B28C 5/08*** | (2006.01) |
| ***B01F 23/53*** | (2022.01) |
| ***B01F 27/90*** | (2022.01) |
| ***B01F 35/71*** | (2022.01) |
| *B01F 101/28* | (2022.01) |

(52) U.S. Cl.
CPC ..... *B01F 35/71775* (2022.01); *B28C 5/0818* (2013.01); *B01F 2101/28* (2022.01)

(56) References Cited

U.S. PATENT DOCUMENTS

| | | | | | |
|---|---|---|---|---|---|
| 6,126,307 | A * | 10/2000 | Black | B28C 7/0422 | 366/65 |
| 6,832,851 | B1 | 12/2004 | von Wilcken | | |
| 2016/0114299 | A1 * | 4/2016 | Shalata | B01F 35/511 | 366/129 |

FOREIGN PATENT DOCUMENTS

| | | | |
|---|---|---|---|
| GB | 2459928 | * | 11/2009 |
| GB | 2459928 | A | 11/2009 |
| GB | 2459929 | A | 11/2009 |
| JP | 2006088417 | A | 4/2006 |

* cited by examiner

MIXING APPARATUS AND METHOD FOR PREPARING MORTAR

FIELD OF THE INVENTION

This invention relates to a mixing apparatus and method for preparing mortar and in particular to a portable apparatus for preparing batches of mortar on a construction site.

The invention relates particularly to an apparatus for mixing a dry substance, e.g. cement or mortar, with a liquid, e.g. water. The apparatus is particularly suited for use with silos, especially dry mortar silos.

BACKGROUND OF THE INVENTION

Typically mortar for construction purposes is prepared off site, by mixing of sand, cement and water. Subsequently the wet mix is conveyed to a construction site in specially adapted vehicles having a rotating drum for mixing the mortar. However, a significant drawback with this process is that the mortar begins to set as soon as the binder (cement) comes into contact with moisture, therefore the mixed wet mortar must be used quickly and, due to the difficulty in delivering exactly the required amount of mortar, considerable wastage may occur.

More recently, attempts have been made to overcome the abovementioned disadvantages by delivering a dry mixture of sand and cement to the construction site, known as dry mortar, and feeding metered quantities of the dry mortar to a mixing chamber wherein the dry mortar is mixed with water. Such dry mortar is typically conveyed to a construction site in a silo mountable on the back of a lorry, the silo being mounted on a support frame whereby the silo can be mounted in an upright position once removed from the lorry. A conveying and mixing device is provided at a lower end of the silo comprising a horizontally arranged passage having a rotatable shaft mounted therein driven by an electric motor, a first part of the passage defining a screw conveyor for conveying dry mortar from the silo to a second part of the passage defining a coaxial mixing chamber wherein a second part of the shaft is provided with mixing blades, water being supplied into the mixing chamber for producing wet mortar at an outlet of the mixing chamber. An example of such arrangement is shown in U.S. Pat. No. 4,855,960.

A disadvantage of such known dry silo mortar systems is that, due to the large loads placed upon the electric motor due to the requirement to both convey dry material through the screw conveyor to the mixing chamber and mix and convey wet material through the mixing chamber, motor failures are common, along with failure of the bearings and seals associated with the motor. Also, due to the coaxial arrangement of the screw conveyor and the mixing chamber, there is a risk of contamination of the screw conveyor with water, which can lead to blocking of the screw conveyor and damage thereto. Also, the horizontal mounting of the conveying and mixing device at the bottom of the silo limits the height of the mortar outlet, limiting the size of container that can be placed therebeneath for receiving mixed wet mortar, and creates a large back pressure upon the motor. An object of the present invention is to provide an improved mixing apparatus that mitigates these disadvantages.

SUMMARY OF THE INVENTION

According to a first aspect, the present invention provides a mixing apparatus for preparing mortar comprising a screw conveyor for conveying dry material, such as a mixture of sand and cement, from a storage vessel to a mixing chamber, said mixing chamber having an inlet end, adapted to receive dry material from an outlet end of said screw conveyor, an outlet end for dispensing wet mortar, and a water feed intermediate said inlet and outlet ends for delivering a metered flow or quantity of water into the mixing chamber, a mixing device being provided within said mixing chamber for mixing said dry material and water and for controlling the passage of material from said inlet to said outlet end of the mixing chamber, wherein said outlet end of said screw conveyor is located above said inlet end of said mixing chamber such that dry material falls from the outlet end of the screw conveyor into the mixing chamber under gravity. As such, separation is maintained between the dry material in the screw conveyor and the wet material in the mixing chamber.

Preferably the outlet end of the mixing chamber includes a flow control device. Said flow control device may comprise a gate valve.

Preferably the outlet end of the screw container communicates with the inlet end of the mixing chamber via a vertical or steeply inclined passage extending therebetween in a downwardly extending direction.

Preferably an auger or screw of said screw conveyor is rotatable by means of a first motor, said mixing device of said mixing chamber being rotatable by means of a second motor, said first and second motors being controllable independently whereby the flow rate of dry material through the screw conveyor and the flow of wet material through the mixing chamber can be controlled independently. In one embodiment said first and second motors comprise electric motors. Said motors may be connected to the respective shafts of the screw conveyor and mixing device by suitable reduction gears.

Preferably said screw conveyor is mounted in an upwardly inclined configuration, thereby enabling the mixing chamber to be positioned at a height independent of the position of the storage vessel.

Preferably said mixing chamber comprises a cylindrical chamber, said mixing device being rotatably mounted within said chamber for rotation about a rotational axis coaxial with the axis of said cylindrical chamber. In a preferred embodiment, said mixing chamber is arranged in an inclined, vertical or substantially vertical orientation with said inlet end at an upper end and said outlet end at a lower end, said mixing device being arranged to control the passage of material through the mixing chamber. By arranging the mixing chamber vertically, any back torque on the mixing device is minimised because the wet material effectively passes through the mixing chamber under the action of gravity.

Preferably the mixing chamber is formed from or at least is lined with a polymeric material, such as polyurethane. The mixing chamber may be formed from two parts, preferably upper and lower parts separable about a horizontal plane, to permit access to the interior of the mixing chamber for maintenance and/or cleaning.

Preferably said mixing device comprises a mixing auger comprising a shaft mounted coaxially within said cylindrical mixing chamber and having a plurality of radially extending mixing blades. Preferably each of said blades has a leading edge and a trailing edge with respect to the direction of rotation of the shaft of the mixing device. The blades in at least an upper region of the mixing auger are preferably mounted at an angle or pitch such that the leading edge of each blade is lower than the trailing edge thereof whereby the blades convey wet material through the mixing chamber during rotation of the blades. Preferably one or more of the blades in a lowermost region of the mixing auger are mounted at an angle or pitch such that the leading edge of each blade is higher than the trailing edge thereof whereby said one or more lowermost blades convey wet material upwardly against the flow of material through the mixing chamber during rotation of said blades.

Preferably each blade in at least said upper region of the auger has a pitch of between 20° and 30°, more preferably between 20° and 25°.

Preferably said blades are provided in axially spaced sets or groups, the blades in each set being arranged at equally circumferential spacing in a respective horizontal plane. Preferably the two lowest sets of blades are arranged with their leading edges higher than their trailing edges.

Preferably, each set of blades comprise at least two, more preferably at least three equally spaced blades. In one embodiment, each set of blades comprises four equally spaced blades. Preferably respective blades of each set are axially aligned with respective blades of each adjacent group.

In a preferred embodiment, elongate rods are joined to and extend between respective axially aligned blades of each group. Preferably each elongate rod extends substantially parallel to the rotational axis of said shaft of the mixing device. Preferably at least one or more of said elongate rods are joined to the blades at or adjacent an outer end of the blades. In one embodiment, an elongate rod is joined to and extends between the trailing edges of respective axially aligned blades of each group, preferably at an outer end of each blade. Preferably one or more further elongate rods are provided extending between leading edges of respective axially aligned blades, preferably joined to said blades at a location between inner and outer ends of each blade.

According to a further aspect of the present invention there is provided a transportable apparatus for on-site preparation of batches of mortar comprising a silo for containing a dry material, such as a mixture of sand and cement, said silo having upper and lower ends, a mixing apparatus for preparing mortar comprising a screw conveyor extending from a lower end of said silo for conveying dry material from the silo to a mixing chamber, said mixing chamber having an inlet end, for receiving dry material from an outlet end of said screw conveyor, an outlet end for dispensing wet material, and a water feed intermediate said inlet and outlet ends for delivering a metered flow or quantity of water into the mixing chamber, a mixing device being provided within said mixing chamber for mixing said dry material and water and for controlling the passage of material from said inlet to said outlet end of the mixing chamber, wherein said outlet end of said screw conveyor is located above said inlet end of said mixing chamber such that dry material falls from the outlet end of the screw conveyor into the mixing chamber under gravity, and wherein the mixing device comprises a mixing auger comprising a rotatably mounted shaft having a plurality of radially extending mixing blades mounted thereon, wherein said blades on at least an upper region of said mixing auger are angled to convey material in a downwards direction wherein the blades on a lower region of the mixing auger are angled to convey material in an upwards direction.

Preferably said silo is provided with a framework for supporting the silo in a substantially upright orientation with said upper end above said lower end.

Preferably the apparatus is adapted for transportation by a vehicle with the silo arranged in a horizontal orientation. Preferably said vehicle comprises a horizontal bed with said upper and lower ends of the silo being locatable at or adjacent opposite ends of said bed.

According to a further aspect of the present invention there is provided a method for on-site preparation of batches of mortar comprising conveying dry material, such as a mixture of sand and cement, from a silo to a mixing chamber in a screw conveyor having a screw rotatably driven by a first motor, passing said dry material from an outlet end of said screw conveyor into an inlet end of said mixing chamber under gravity, passing water into said mixing chamber and agitating and conveying the mixture of dry material and water through the mixing chamber by rotation of a mixing auger within the mixing chamber rotatably driven by a second motor, to deliver wet mixed material from an outlet end of said mixing chamber, including controlling the flow rate of material through the outlet end of the mixing chamber by controlling the size of a discharge opening at said outlet end of the mixing chamber.

According to a further aspect of the present invention there is provided a mixing apparatus comprising a conveying chamber and a mixing chamber, said conveying chamber being provided with a powered conveying device driven by a first drive device for conveying dry material between an inlet end communicating with a storage vessel and an outlet end communicating with an inlet end of the mixing chamber, said mixing chamber being provided with a powered mixing device driven by a second drive device and a water supply device for supplying water to the mixing chamber, whereby said mixing device is arranged to mix said dry material with said water and control the passage of said mixture between said inlet end of the mixing chamber and an outlet end thereof, a control device being provided for independently controlling said first and second drive devices whereby the flow rate of dry material through the screw conveyor and the flow of wet material through the mixing chamber can be controlled independently, including a flow control device for controlling the flow rate of material through the outlet end of the mixing chamber.

Preferably said outlet end of said conveying chamber is located above said inlet end of said mixing chamber such that dry mortar falls from the outlet end of the screw conveyor into the mixing chamber under gravity.

Preferably the mixing device comprises a mixing auger comprising a rotatably mounted shaft having a plurality of radially extending mixing blades mounted thereon, wherein said blades on at least an upper region of said mixing auger are angled to convey material in a downwards direction wherein the blades on a lower region of the mixing auger are angled to convey material in an upwards direction.

BRIEF DESCRIPTION OF THE DRAWINGS

An embodiment of the present invention will now be described, by way of example only, with reference to the accompanying drawings, in which.

DETAILED DESCRIPTION OF THE DRAWINGS

Figure 1:
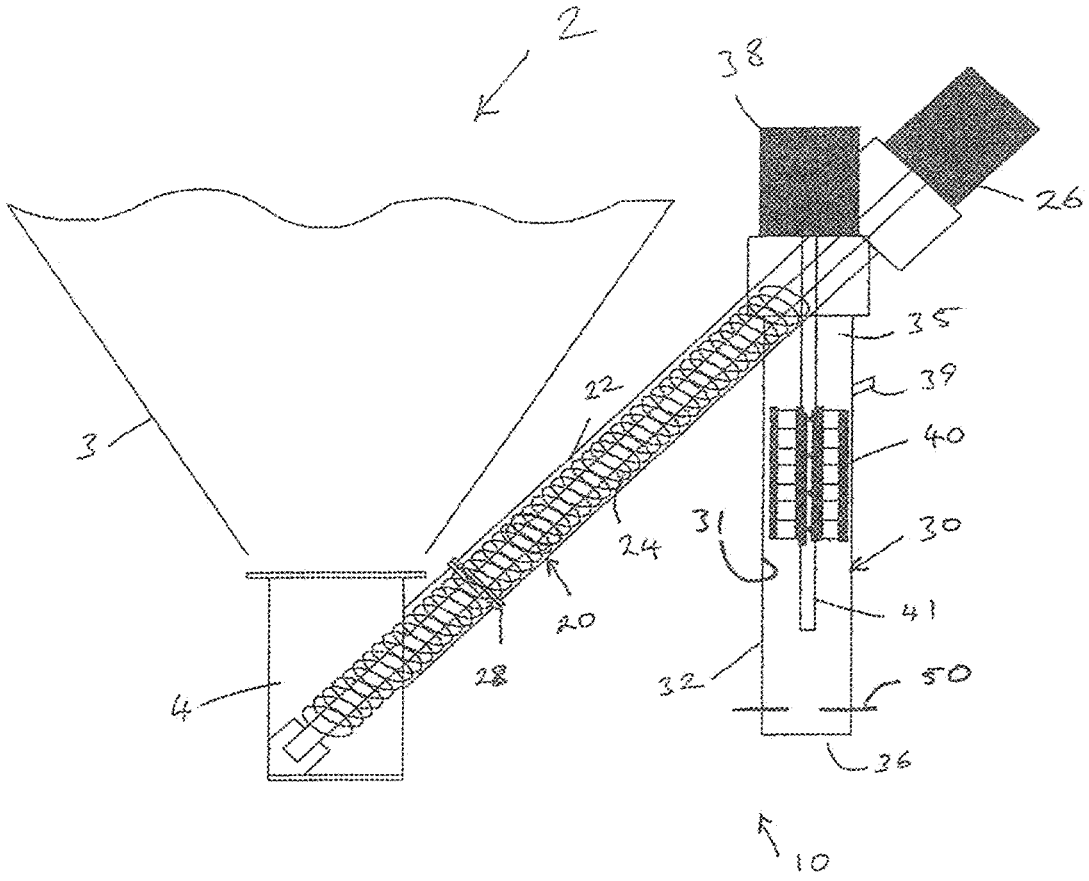
FIG. 1 is a schematic view of a mixing apparatus according to an embodiment of the present invention.

As illustrated in the drawings, a dry silo mortar system according to the present invention comprises a portable silo 2 mounted on a supporting frame and having a cylindrical upper section (not shown) and a funnel shaped lower section 3 for containing a dry mortar comprising a mixture of sand and cement. The silo 2 is adapted to for transportation by a truck with the silo arranged in a horizontal orientation, the truck having a horizontal bed, the silo being mounted on the bed with the upper and lower ends of the silo being locatable at or adjacent opposite ends of the truck bed. Once delivered to a construction site, the silo is lifted to an upright configuration, resting upon the supporting frame of the silo in a substantially upright orientation with said upper end above said lower end. Alternatively the silo may comprise a substantially permanent structure.

A mixing apparatus 10 is mounted on a lower end of the silo 2 comprising a screw conveyor 20 and a mixing chamber 30.

The screw conveyor 20 extends upwardly from a lower end 4 of the silo 2 and comprises a cylindrical passage 22 having a rotary spiral feed screw 24 coaxially mounted therein, the feed screw 24 being rotatable by means of an electric motor 26 connected to an upper end of the screw via a reduction gearbox to convey dry mortar from the silo 2 to the mixing chamber 30. In order to enable removal and servicing of the screw conveyor 20 from the silo 2, a lower region of the passage 22 is separable from the upper region of the passage 22 by a separable flange 28.

The mixing chamber 30 comprises a vertically oriented cylinder 32 having an upper inlet end 35, adapted to receive dry material from an outlet end of the screw conveyor, and an open lower discharge opening 36. A rotatable mixing auger 40 is coaxially mounted within the tube 32 to be rotatable by an electric motor 38 connected to an upper end of the mixing auger 40 via a reduction gearbox. A water supply passage 39 is provided in a side region of the mixing chamber for delivering a metered flow of water into the mixing chamber, said water supply passage being connectable to a source of water via a metering valve.

The mixing chamber 30 is formed from or at least is lined with a polymeric material 31, such as polyurethane, to prevent the mortar from sticking to the walls of the chamber 30 and to reduce wear, and facilitate replacement of the liner should wear occur. Preferably the mixing chamber is formed from two separable parts to facilitate access to the chamber 30.

Figure 2:
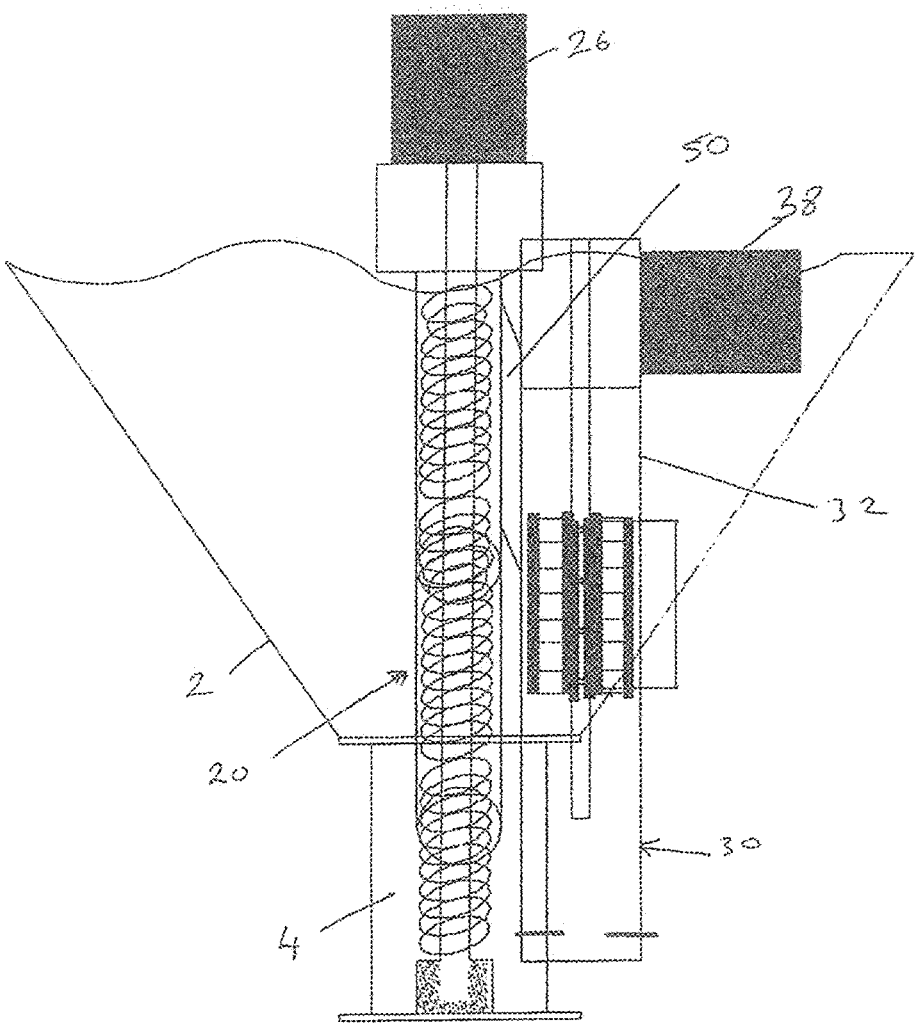
FIG. 2 is a side view of the apparatus of FIG. 1.

Dry material is delivered from an upper end of the screw conveyor 20 into the mixing chamber 30 via a steeply inclined delivery pipe 50 (see FIG. 2) whereby dry material falls from the upper end of the screw conveyor 20 into the mixing chamber 30 under gravity, thus preventing contamination of the dry material within the screw conveyor 20.

The rotatable mixing auger 40 within the mixing chamber 30 mixes the dry material with water to provide a wet mortar and controls the passage of the mortar through the mixing chamber 30. The mixing auger 40 comprises a shaft 41 mounted coaxially within said cylindrical mixing chamber 30 and having a plurality of radially extending mixing blades 42. The blades on at least an upper region of said mixing auger are preferably angled to convey material in a downwards direction wherein the blades on a lower region of the mixing auger are preferably angled to convey material in an upwards direction. Each of said blades 42 has a leading edge 43 and a trailing edge 44 with respect to the direction of rotation of the shaft 41. The blades 42 on at least an upper region of the mixing auger 40 are mounted at an angle or pitch such that the leading edge 43 of each blade 42 is lower than the trailing edge 44 thereof whereby the blades 42 convey wet material through the mixing chamber 40 during rotation of the blades 42 and act to retain wet material within the mixing chamber 40 due to the width of the blades 42.

Preferably the lowermost two sets of blades 42 of the mixing auger 40 are reversed when compared to the blades above, with their leading edges 42 above their trailing edges 44, such that the lowermost sets of blades act as an opposing force to re-distribute the mixed material back up into the mixing chamber 30 momentarily, allowing for additional air to be incorporated into the mix which changes the viscosity of the mortar. At slower shaft rotations the mortar is not disturbed by the blades, when the shaft RPM is increased the blades on the shaft causes more turbulence in the mix material giving the desired consistency.

Figure 3:
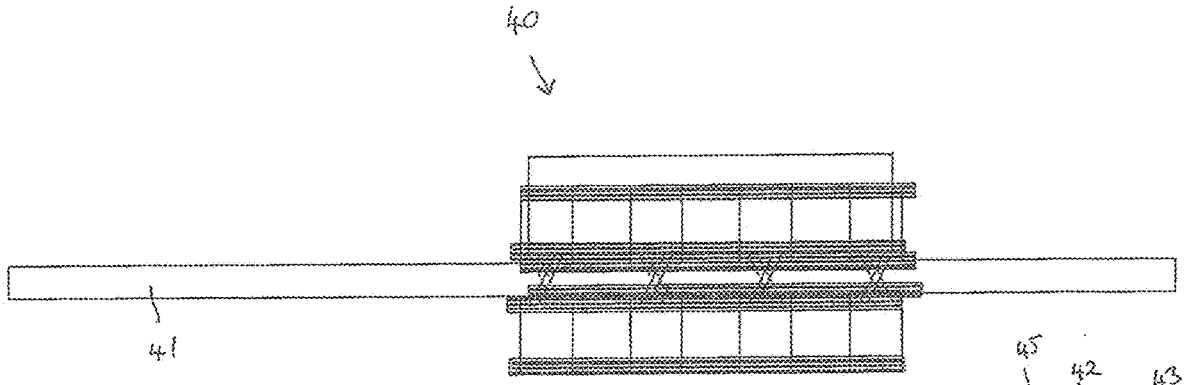
FIG. 3 is a side view of the mixing auger of the mixing chamber of the mixing apparatus of FIG. 1.
Figure 4:
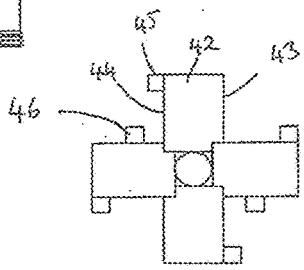
FIG. 4 is an end view of the mixing auger of FIG. 3.

As shown in FIGS. 3 and 4, the blades 42 are arranged in axially spaced sets or groups, each set comprising four equally spaced blades. In the embodiment illustrated, eight sets of blades are provided, each group comprising four equally spaced blades, the lowermost two sets of blades 42 being reversed compared to the sets above. However, more or less groups may be provided, each group having more or less blades, depending upon the size of the mixing chamber and the consistency of the mortar to be produced. Respective blades of each group may be axially aligned with respective blades of each adjacent group.

To provide enhanced mixing and control of the movement of the wet mortar through the mixing chamber, elongate rods 45 may be joined to and extend between respective axially aligned blades 42 of each group, each elongate rod 45 preferably extends substantially parallel to the rotational axis of said shaft 41 of the mixing auger. The elongate rods 45 may be joined to and extend between the trailing edges 44 of the axially aligned blades 42, preferably joined to the blades 42 adjacent an outer edge thereof. Preferably one or more further elongate rods 46 are provided extending between leading edges 43 of respective axially aligned blades 42, preferably joined to said blades 42 at a location between inner and outer ends of each blade 42.

A gate valve 50 is provided at a lower end of the mixing chamber for controlling the size of the discharge opening of the mixing chamber 30. The gate valve may comprise a pair of valve members arranged to move towards and away from one another to vary the size of the discharge opening of the mixing chamber 30.

An electronic control device may be provided for controlling the operation of the first and second motors, the water supply and optionally the gate valve 50, such control device being programmable to suit the properties of the mortar to be produced.

In use, when it is desired to dispense a batch of wet mortar, the motor 26 of the screw conveyor 20 is activated to feed dry material into the upper end 35 of the mixing chamber 30 while the metering valve is operated to supply the required flow rate of water into the mixing chamber 30 and the second motor 38 is activated to rotate the mixing auger 40 at the required speed to mix the dry mortar with the water and to control the passage of the mortar through the mixing chamber 30 and out of the lower discharge opening 36 of the mixing chamber 30 into a suitable receptacle placed beneath said discharge opening 36. The valve members of the gate valve 50 are set to provide the desired dimensions for the discharge opening of the mixing chamber 30

By providing separate motors for the screw conveyor 20 and the mixing auger 40 of the mixing chamber 30, lower power motors can be used and greater motor reliability can be achieved. Furthermore, the vertical orientation of the mixing chamber 30 minimises the back pressure applied to the second motor 38 as, unlike prior art systems, the mixing auger does not need to push the wet mortar against the force of gravity, thereby reducing the load on the motor 38. The reversed blades 42 on the lowermost pair of Once a batch of wet mortar has been dispensed, the apparatus can be cleaned by shutting off the first motor 26 to stop the screw conveyor 20 while maintaining power to the second motor 38 to continue to rotate the mixing auger while continuing to supply water to the water supply passage 39 to wash out the mixing chamber 30.

The polyurethane liner 41 of the mixing chamber 30 reduces and almost eliminates entirely the common issue arising from aggregate interference and premature failure of a metallic mixing augur and chamber.

The polyurethane liner 41 in essence and by nature is highly abrasion resistant and tear resistant, these two feature properties create a flexible mixing liner system which can deflect when a large piece of material interferes with the mixing augur 40 and the chamber wall. Another feature of this design is the non-stick properties of the liner which prevented excess material from bonding to the inside of the chamber, thus reducing mixer load at start up and reducing friction, wear and energy consumption of the apparatus.

The two piece design allows for ease of access to the complete mixing chamber area for visual inspection and maintenance.

The development of the angular positioning of the agitating blades was carried out through testing and the requirement to provide a variation in water content and mix viscosity of the mortar that is to be produced. These blades are located at the exit of the mixing chamber and assist with the homogenization of dry material, liquid and air. By varying the speed of the shaft the blades act as an opposing force to re-distribute the mixed material back up into the chamber momentarily, allowing for additional air to be incorporated into the mix which changes the viscosity of the mortar. At slower shaft rotations the mortar is not disturbed by the blades, when the shaft RPM is increased the blades on the shaft causes more turbulence in the mix material giving the desired consistency.

The development of the outlet nozzle came from a requirement for the machine to be flexible with various manufacturers materials that are used on site. This enables the machine to be adjusted instead of the manufacturers having to adjust their supplied material to suit an onsite mixing machine, reducing cost of additives, this in turn feeds down to reducing costs to the manufacturer.

This was achieved by the development of a variable outlet nozzle that uses two opposing blades on the material exit port. The relative positions of these blades are adjustable. When in the fully open position this allows for screed to be produced. When the blades are slid with respect to one another on the slotted mounts into a reduced variable outlet position this enables the air content of mortar or plaster to be controlled.

The invention is not limited to the embodiment(s) described herein but can be amended or modified without departing from the scope of the present invention.

The invention claimed is:

1. A mixing apparatus for preparing wet mortar from water and dry material, such as a mixture of sand and cement, the mixing apparatus comprising:

a screw conveyor for conveying the dry material from a storage vessel, the screw conveyor having an outlet end from which the dry material falls under gravity;

a cylindrical mixing chamber, comprising:

an inlet end, arranged below the outlet end of the screw conveyor to receive the dry material from an outlet end of the screw conveyor;

an outlet end for dispensing wet mortar, and a water feed, intermediate to the inlet and outlet ends of the mixing chamber for delivering into the mixing chamber a metered flow or quantity of water;

a mixing device, positioned within the mixing chamber for mixing the dry material and water and for controlling the passage of material between the inlet and outlet ends of the mixing chamber, the mixing device having a mixing auger comprising:

a shaft mounted coaxially within the cylindrical mixing chamber;

a plurality of mixing blades extending radially from the shaft; wherein each blades has a leading edge and a trailing edge with respect to the direction of rotation of the shaft, wherein the blades in at least an upper region of the mixing auger are mounted at an angle or pitch such that the leading edge of each of these blades is lower than the trailing edge thereof, whereby that the blades convey wet material through the mixing chamber during rotation of the mixing auger; and wherein at least one of the blades in a lowermost region of the mixing auger is mounted at an angle or pitch, such that the leading edge of each of these blades is higher than the trailing edge thereof, whereby the wet material is conveyed upwardly against the flow of material through the mixing chamber during rotation of the mixing auger;

wherein a separation of the inlet end of the mixing chamber from the outlet end of the screw conveyor maintains a separation between the dry material in the screw conveyor and the wet material in the mixing chamber.

2. The mixing apparatus of claim 1, wherein the outlet end of the mixing chamber includes a flow control device.

3. The mixing apparatus of claim 2, wherein said flow control device comprises a gate valve.

4. The mixing apparatus of claim 1, wherein the outlet end of the screw container communicates with the inlet end of the mixing chamber via a vertical or steeply inclined passage extending therebetween in a downwardly extending direction.

5. The mixing apparatus of claim 1, wherein an auger or screw of said screw conveyor is rotatable by means of a first motor, said mixing device of said mixing chamber being rotatable by means of a second motor, said first and second motors being controllable independently whereby the flow rate of dry material through the screw conveyor and the flow of wet material through the mixing chamber can be controlled independently.

6. The mixing apparatus of claim 5, wherein said first and second motors comprise electric motors.

7. The mixing apparatus of claim 6, wherein said motors are connected to the respective shafts of the screw conveyor and the mixing device by suitable reduction gears.

8. The mixing apparatus of claim 1, wherein said screw conveyor is mounted in an upwardly inclined configuration, thereby enabling the mixing chamber to be positioned at a height independent of the position of the storage vessel.

9. The mixing apparatus of claim 1, wherein said mixing chamber comprises a cylindrical chamber, said mixing device being rotatably mounted within said chamber for rotation about a rotational axis coaxial with the axis of said cylindrical chamber.

10. The mixing apparatus of claim 9, wherein said mixing chamber is arranged in an inclined, vertical or substantially vertical orientation with said inlet end at an upper end and said outlet end at a lower end, said mixing device being arranged to control the passage of material through the mixing chamber.

11. The mixing apparatus of claim 9, wherein the mixing chamber is formed from or at least is lined with a polymeric material.

12. The mixing apparatus of claim 11, wherein said polymeric material comprises polyurethane.

13. The mixing apparatus of claim 9, wherein the mixing chamber is formed from two parts to permit access to the interior of the mixing chamber for maintenance and/or cleaning.

14. The mixing apparatus of claim 13, wherein said two parts comprise an upper part and a lower part, said two parts being separable in a substantially horizontal plane.

15. The mixing apparatus of claim 13, wherein said two parts are separable about a plane aligned with the rotational axis of the mixing device.

16. The mixing apparatus of claim 1, wherein the blades of the mixing device are provided in axially spaced sets or groups, the blades in each set being arranged at equally circumferential spacing in a respective horizontal plane.

17. The mixing apparatus of claim 16, wherein the two lowest sets of blades are arranged with their leading edges higher than their trailing edges, the blades of the remaining sets being arranged with their leading edges lower than their trailing edges.

18. The mixing apparatus of claim 16, wherein each set of blades comprise at least two equally spaced blades.

19. The mixing apparatus of claim 18, wherein respective blades of each set are axially aligned with respective blades of each adjacent group.

20. The mixing apparatus of claim 19, wherein elongate rods are joined to and extend between respective axially aligned blades of each set.

21. The mixing apparatus of claim 20, wherein each elongate rod extends substantially parallel to the rotational axis of the mixing device.

22. A transportable apparatus for on-site preparation of batches of mortar comprising a silo for containing a dry material, such as a mixture of sand and cement, said silo having upper and lower ends, a mixing apparatus for preparing mortar comprising a screw conveyor extending from a lower end of said silo for conveying dry material from the silo to a mixing chamber, said mixing chamber having an inlet end, for receiving dry material from an outlet end of said screw conveyor, an outlet end for dispensing wet material, and a water feed intermediate said inlet and outlet ends for delivering a metered flow or quantity of water into the mixing chamber, a mixing device being provided within said mixing chamber for mixing said dry material and water and for controlling the passage of material from said inlet to said outlet end of the mixing chamber, wherein said outlet end of said screw conveyor is located above said inlet end of said mixing chamber such that dry material falls from the outlet end of the screw conveyor into the mixing chamber under gravity, and wherein the mixing device comprises a mixing auger comprising a rotatably mounted shaft having a plurality of radially extending mixing blades mounted thereon, wherein said blades on at least an upper region of said mixing auger are angled to convey material in a downwards direction wherein the blades on a lower region of the mixing auger are angled to convey material in an upwards direction.

23. The apparatus of claim 22, wherein said silo is provided with a framework for supporting the silo in a substantially upright orientation with said upper end above said lower end.

24. The apparatus-of claim 22, wherein the apparatus is adapted for transportation by a vehicle with the silo arranged in a horizontal orientation.

25. The apparatus of claim 24, wherein said vehicle comprises a horizontal bed with said upper and lower ends of the silo being locatable at or adjacent opposite ends of said bed.

26. A method for on-site preparation of batches of mortar comprising conveying dry material, such as a mixture of sand and cement, from a silo to a mixing chamber in a screw conveyor having a screw rotatably driven by a first motor, passing said dry material from an outlet end of said screw conveyor into an inlet end of said mixing chamber under gravity, passing water into said mixing chamber and agitating and conveying the mixture of dry material and water through the mixing chamber by rotation of a mixing auger within the mixing chamber rotatably driven by a second motor, to deliver wet mixed material from an outlet end of said mixing chamber, including controlling the flow rate of material through the outlet end of the mixing chamber by controlling the size of a discharge opening at said outlet end of the mixing chamber, wherein said mixing auger comprises mixing blades mounted to a shaft, where at least some of the mixing blades are mounted at an angle or pitch to the shaft such that the leading edge of each of these blades is lower than the trailing edge thereof, and at least some other of the mixing blades are mounted to the shaft at an angle or pitch, such that the leading edge of each of these blades is higher than the trailing edge thereof.

27. A mixing apparatus comprising a conveying chamber and a mixing chamber, said conveying chamber being provided with a powered conveying device driven by a first drive device for conveying dry material between an inlet end communicating with a storage vessel and an outlet end communicating with an inlet end of the mixing chamber, said mixing chamber being provided with a powered mixing device driven by a second drive device and a water supply device for supplying water to the mixing chamber, whereby said mixing device is arranged to mix said dry material with said water and control the passage of said mixture between said inlet end of the mixing chamber and an outlet end thereof, a control device being provided for independently controlling said first and second drive devices whereby the flow rate of dry material through the screw conveyor and the flow of wet material through the mixing chamber can be controlled independently, including a flow control device for controlling the flow rate of material through the outlet end of the mixing chamber, wherein the mixing device comprises a mixing auger comprising a rotatably mounted shaft having a plurality of radially extending mixing blades mounted thereon, wherein said blades on at least an upper region of said mixing auger are angled to convey material in a downwards direction, and wherein the blades on a lower region of the mixing auger are angled to convey material in an upwards direction.

28. The mixing apparatus of claim 27, wherein said outlet end of said conveying chamber is located above said inlet end of said mixing chamber such that dry mortar falls from the outlet end of the screw conveyor into the mixing chamber under gravity.

* * * * *